US011329417B2

(12) United States Patent
Inoue

(10) Patent No.: US 11,329,417 B2
(45) Date of Patent: May 10, 2022

(54) CONNECTOR

(71) Applicant: Sumitomo Wiring Systems, Ltd., Yokkaichi (JP)

(72) Inventor: Yuta Inoue, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 16/912,796

(22) Filed: Jun. 26, 2020

(65) Prior Publication Data

US 2021/0013666 A1 Jan. 14, 2021

(30) Foreign Application Priority Data

Jul. 9, 2019 (JP) ..... JP2019-127521

(51) Int. Cl.
*H01R 13/514* (2006.01)
*H01R 13/504* (2006.01)
*H01R 13/405* (2006.01)

(52) U.S. Cl.
CPC ..... *H01R 13/504* (2013.01); *H01R 13/405* (2013.01); *H01R 13/514* (2013.01)

(58) Field of Classification Search
CPC .. H01R 13/502; H01R 13/504; H01R 13/514; H01R 13/40; H01R 13/405
USPC ..... 439/701
See application file for complete search history.

(56) References Cited

U.S. PATENT DOCUMENTS

2002/0026710 A1* 3/2002 Murakami ..... H01R 13/514 29/883
2018/0183171 A1* 6/2018 Washio ..... H01R 31/08

FOREIGN PATENT DOCUMENTS

JP 2012-099274 5/2012
WO WO-2009148027 A1 * 12/2009 ..... H01R 13/514

* cited by examiner

*Primary Examiner* — Khiem M Nguyen
(74) *Attorney, Agent, or Firm* — Gerald E. Hespos; Michael J. Porco; Matthew T. Hespos

(57) ABSTRACT

It is aimed to provide a connector capable of simplifying a configuration. A connector (10) is provided with metal terminals (30), two primary molded bodies (20) including cores (40) made of resin and molded while holding the metal terminals (30), and a housing (50) made of resin and molded with the primary molded bodies (20) inserted. The primary molded bodies (20) have the same shape and are overlapped with one inverted with respect to the other. Engaging portions to be engaged with each other are provided on surfaces of the cores that face each other.

6 Claims, 4 Drawing Sheets

CONNECTOR

BACKGROUND

Field of the Invention

This disclosure relates to a connector.

Related Art

Japanese Unexamined Patent Publication No. 2012-99274 discloses a connector that includes metal terminals, two primary molded bodies including cores molded while holding the metal terminals, and a housing. The primary molded bodies are assembled together and form an insert in the housing.

Mating surfaces of the primary molded bodies of the connector described in Japanese Unexamined Patent Publication No. 2012-99274 are overlapped with each other. One of these mating surfaces has fitting recesses and the other mating surface has fitting projections to fit in the respective fitting recesses. The primary molded bodies are positioned with respect to each other by fitting the fitting projections in the respective fitting recesses.

The connector described in Japanese Unexamined Patent Publication No. 2012-99274 is molded with two primary molded bodies having different shapes inserted. Thus, two types of primary molded bodies need to be prepared, and a configuration may become complicated.

This disclosure aims to provide a connector with a simplified configuration.

SUMMARY

This disclosure is directed to a connector with metal terminals, two primary molded bodies including cores made of resin and molded while holding the metal terminals, and a housing made of resin and molded with the primary molded bodies inserted. The primary molded bodies have the same shape and overlap with one inverted with respect to the other. Engaging portions to be engaged with each other are provided on facing surfaces of the cores. In this way, the primary molded bodies and a device such as a mold for molding the primary molded bodies can be used in common. Further, the facing surfaces of the cores in the overlapped primary molded bodies are provided with the engaging portions to be engaged with each other. In this way, two primary molded bodies can be positioned with respect to each other when molding the housing. Thus, the configuration of the connector can be simplified.

The engaging portions may include an engaging projection projecting from the facing surface of one of the cores and an engaging recess formed in the facing surface of the other core and to be engaged with the engaging projection while accommodating the engaging projection.

According to this configuration, the cores will not slip on each other in a surface direction of the facing surfaces or rotate with respect to each other. Thus, the cores can be positioned easily with respect to each other.

The primary molded body holds the metal terminals. The core has a first end surface orthogonal to the facing surface and a second end surface orthogonal to the facing surface and located opposite to the first end surface. Each of the metal terminals includes a first extending portion extending out from the first end surface and a second extending portion extending out from the second end surface. A facing direction of the cores is defined as a facing direction, an extending direction of the first and second extending portions is defined as an extending direction and a direction orthogonal to both the facing direction and the extending direction is defined as an orthogonal direction. With these definitions, the first extending portions and the second extending portions in the primary molded body are arranged at intervals in the orthogonal direction and the second extending portions are closer to the facing surface than the first extending portions in the facing direction. Additionally, with the primary molded bodies overlapped with each other, the first extending portions of one of the primary molded bodies and the first extending portions of the other extending portion are arranged in two rows, whereas the second extending portions of the one primary molded body and the second extending portions of the other primary molded body are arranged in one row. According to this configuration, with the primary molded bodies overlapped, the first and second extending portions are arranged in different manners. Thus, a degree of freedom in the terminal arrangement of the connector can be enhanced while the primary molded bodies having the same shape are used.

In one embodiment, each of the metal terminals includes a bent portion located between the first and second extending portions and bent to be closer to the facing surface while approaching the second extending portion. The engaging portions include a projection projecting from the facing surface of one of the cores and a recess formed in the facing surface of the other core and engageable with the projection. The bent portion is embedded in the projection. According to this configuration, a pressure of the resin during the molding of the housing is less likely to act on the bent portion, and the deformation of the bent portion can be suppressed. Further, by engaging such a projection with the recess of the mating core, the cores are positioned with respect to each other. Thus, a part of the core provided to suppress the deformation of the bent portions and a part thereof to be engaged with the recess of the mating core need not be formed separately. In this way, the shape of the cores can be simplified and a material necessary to mold the cores can be reduced.

According to the present disclosure, it is possible to simplify the configuration of a connector.

DETAILED DESCRIPTION

A specific example of the connector of the present disclosure is described below with reference to the drawings. In each figure, a configuration may be shown partially in an exaggerated or simplified manner for the convenience of description. Further, a dimension ratio of each part may be different in each figure. Note that the present invention is not limited to these illustrations and is intended to be represented by claims and include all changes in the scope of claims and in the meaning and scope of equivalents.

Figure 1:
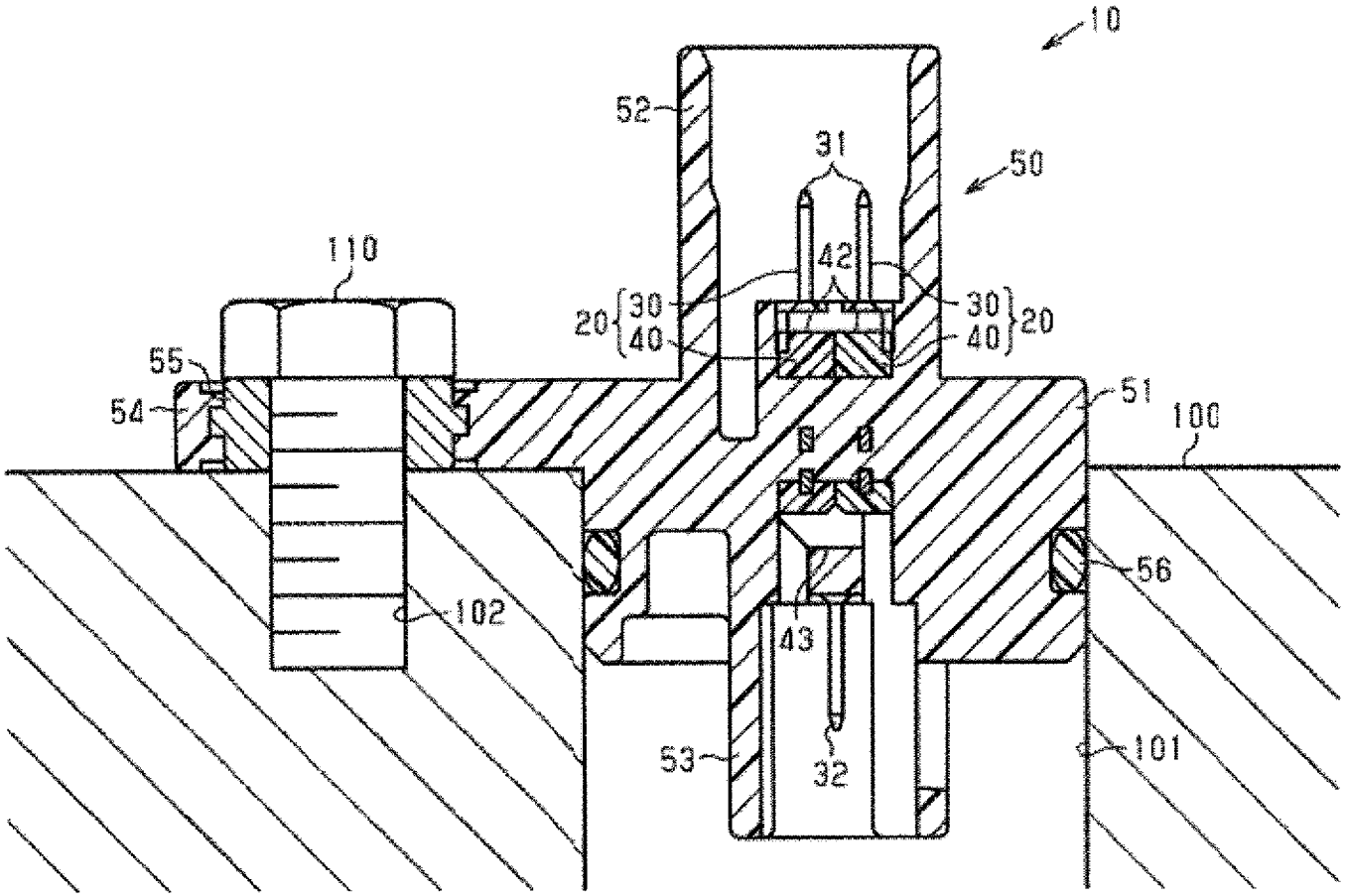
FIG. 1 is a section of a connector and a case in one embodiment.

As shown in FIG. 1, a connector 10 is, for example, mounted into a circular mounting hole 101 formed in a case 100 of a transmission of an automotive vehicle to electrically connect devices (not shown) arranged inside and outside the case 100.

The connector 10 includes metal terminals 30, two primary molded bodies 20 including cores 40 made of resin and molded while holding the metal terminals 30, and a housing 50 made of resin and molded with the primary molded bodies 20 inserted.

<Housing 50>

As shown in FIG. 1, the housing 50 includes a body portion 51 for holding each primary molded body 20, an outer receptacle 52 projecting out of the case 100 from the body portion 51 and an inner receptacle 53 projecting inward of the case 100 from the body portion 51.

A flange 54 projects from the body portion 51 along an outer surface of the case 100 and is used to mount the connector 10 on the case 100. A hollow cylindrical collar 55 is provided on the tip of the flange 54. The connector 10 is mounted on the case 100 by inserting a bolt 110 into the collar 55 and screwing the bolt 110 into a screw hole 102 of the case 100.

An annular sealing member 56 for sealing between the body portion 51 and the mounting hole 101 is provided in a part of the outer peripheral surface of the body portion 51 facing the inner peripheral surface of the mounting hole 101 of the case 100.

Figure 2:
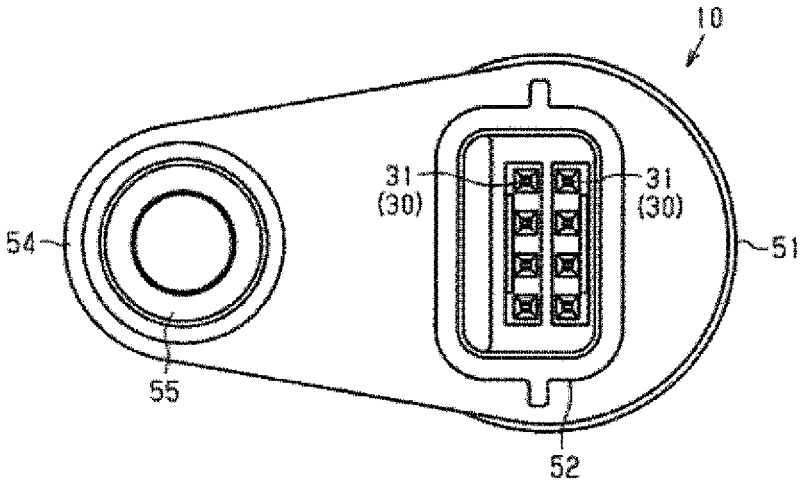
FIG. 2 is a plan view of the connector of the embodiment viewed from the side of an outer receptacle.

As shown in FIG. 2, the outer receptacle 52 has a substantially rectangular tubular shape. The metal terminals 30 are arranged in two rows in the outer receptacle 52.

Figure 3:
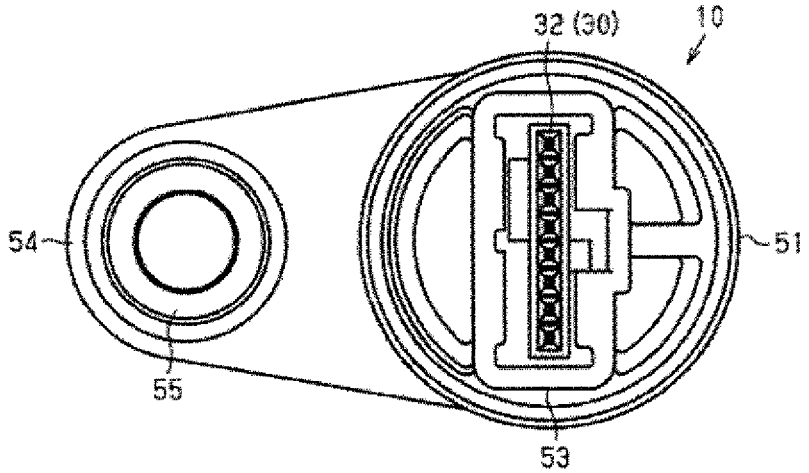
FIG. 3 is a plan view of the connector of the embodiment viewed from the side of an inner receptacle.

As shown in FIG. 3, the inner receptacle 53 has a substantially rectangular tubular shape, and the metal terminals 30 are arranged in one row in the inner receptacle 53.

<Primary Molded Bodies 20>

Figure 4:
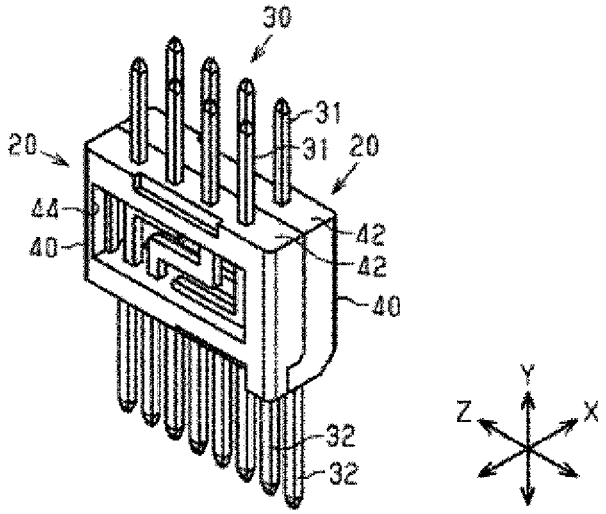
FIG. 4 is a perspective view showing a state where a pair of primary molded bodies of the embodiment are overlapped.
Figure 5:
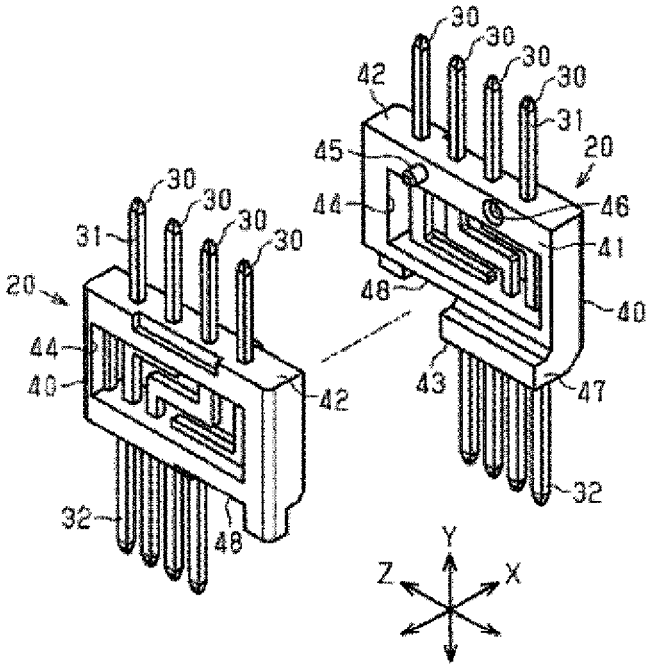
FIG. 5 is an exploded perspective view showing the pair of primary molded bodies of the embodiment separated from each other.

As shown in FIGS. 4 and 5, the pair of primary molded bodies 20 have the same shape and are overlapped with one inverted with respect to the other.

Each core 40 is molded with four metal terminals 30 having different shapes inserted.

The core 40 has a substantially rectangular parallelepiped shape. The core 40 has a facing surface 41 facing the other core 40, a first end surface 42 orthogonal to the facing surface 41 and a second end surface 43 orthogonal to the facing surface 41 and located opposite to the first end surface 42. The first end surface 42 is located on the side of the outer receptacle 52. The second end surface 43 is located on the side of the inner receptacle 53 (see FIG. 1).

As shown in FIG. 5, each metal terminal 30 includes a first extending portion 31 extending outward from the first end surface 42 of the core 40 and a second extending portion 32 extending outward from the second end surface 43.

In the following description, a facing direction of the cores 40 is defined as a facing direction X, an extending direction of the respective first and second extending portions 31, 32 is defined as an extending direction Y and a direction orthogonal to both the facing direction X and the extending direction Y is defined as an orthogonal direction Z.

A through hole 44 having a rectangular shape long in the orthogonal direction Z is formed in a central part of the facing surface 41 of the core 40. With the respective primary molded bodies 20 overlapped with each other, the respective through holes 44 communicate with each other.

As shown in FIG. 5, an engaging projection 45 and an engaging recess 46 are formed at an interval in the orthogonal direction Z on an end part of the facing surface 41 of the core 40 on the side of the first end surface 42 in the extending direction Y. The engaging projection 45 has a cylindrical shape. The engaging recess 46 has such a circular cross-sectional shape that the engaging projection 45 of the mating core 40 can be accommodated thereinto.

The engaging projection 45 projecting from the facing surface 41 of one core 40 is accommodated into the engaging recess 46 formed in the facing surface 41 of the other core 40, whereby the engaging projection 45 and the engaging recess 46 are engaged with each other.

A projection 47 is formed to project on an end part of the facing surface 41 of the core 40 on the side of the second end surface 43 and located opposite to the engaging recess 46 across the through hole 44 in the extending direction Y. The projection 47 extends from a center of the core 40 to one end along the orthogonal direction Z. The projection 47 deviates outward from the center of the core 40 in the orthogonal direction Z. Note that the aforementioned second end surface 43 is an outer surface of the projection 47 orthogonal to the facing surface 41.

A recess 48 is formed in a part of the facing surface 41 of the core 40 adjacent to the projection 47 in the orthogonal direction Z. The projection 47 projecting from the facing surface 41 of one core 40 is engageable with the recess 48 formed in the facing surface 41 of the other core 40.

In this embodiment, the engaging projection 45 and the engaging recess 46, and the projection 47 and the recess 48 are equivalent to an example of an engaging portion.

As shown in FIGS. 4 and 5, the respective first extending portions 31 in the primary molded body 20 are arranged side by side at intervals in the orthogonal direction Z. Similarly, the respective second extending portions 32 in the primary molded body 20 are arranged side by side at intervals in the orthogonal direction Z. Note that the intervals in the orthogonal direction Z between the respective extending portions 31 are larger than those between the respective second extending portions 32.

Figure 6:
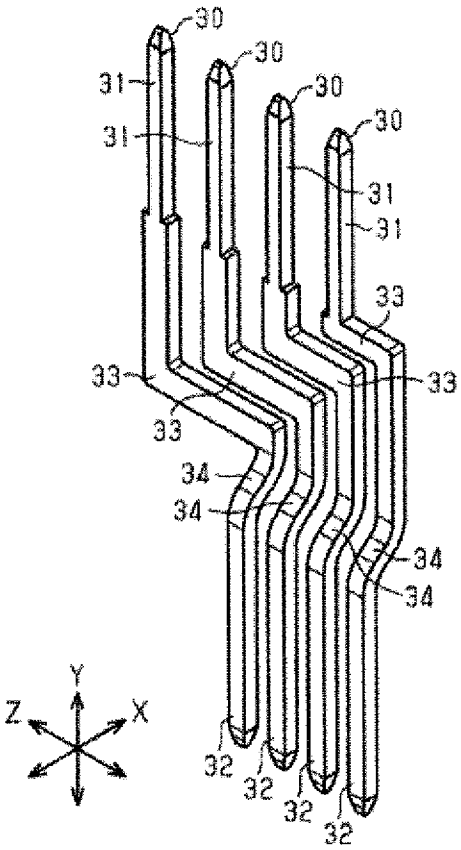
FIG. 6 is a perspective view showing metal terminals of the embodiment.

As shown in FIGS. 5 and 6, the respective second extending portions 32 are arranged closer to the facing surface 41 41 than the respective first extending portions 31 in the facing direction X. Further, the respective second extending portions 32 are arranged to deviate more toward one side than the respective first extending portions 31 in the orthogonal direction Z.

As shown in FIG. 6, an intermediate portion 33 is formed between the first and second extending portions 31, 32 in each metal terminal 30. The intermediate portion 33 is located on the same plane as the first extending portion 31 and includes a part extending along the extending direction Y and a part bent from the former part and extending along the orthogonal direction Z. The shapes of the intermediate portions 33 differ from each other in four metal terminals 30 held by the core 40.

Figure 7:
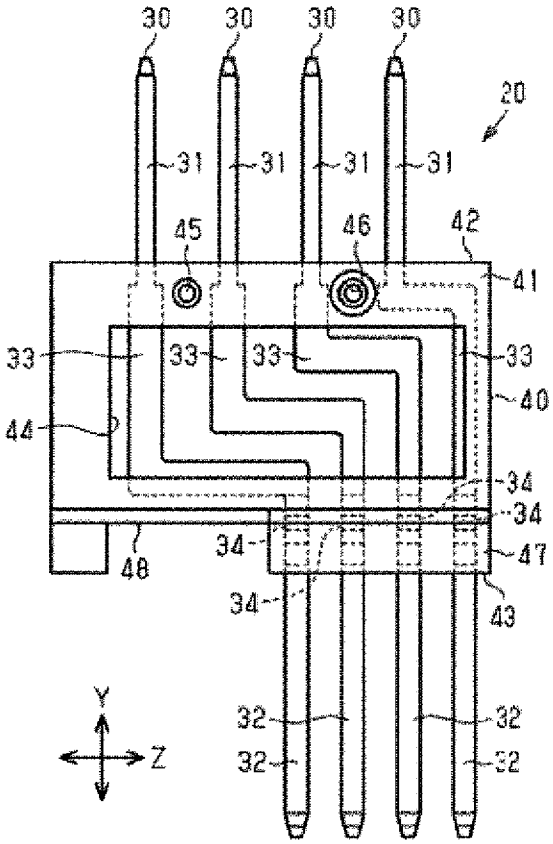
FIG. 7 is a front view showing the primary molded body of the embodiment viewed from a facing surface side.

A bent portion 34 bent to be located closer to the facing surface 41 while approaching the second extending portion 32 is formed between the intermediate portion 33 and the second extending portion 32. As shown in FIG. 7, each bent portion 34 is embedded in the projection 47 of the core 40.

As shown in FIG. 4, with the primary molded bodies 20 overlapped with each other, the first extending portions 31 of one primary molded body 20 and the first extending portions 31 of the other primary molded body 20 are arranged in two rows. Further, the second extending portions 32 of the one primary molded body 20 and the second extending portions 32 of the other primary molded body 20 are arranged in one row. At this time, the facing surfaces 41 of the respective cores 40 are in contact with each other.

Functions and effects of this embodiment are described.

The connector 10 is provided with the metal terminals 30, the two primary molded bodies 20 including the cores 40 made of resin and molded while holding the metal terminals 30, and the housing 50 made of resin and molded with the primary molded bodies 20 inserted. The primary molded bodies 20 have the same shape and are overlapped with one inverted with respect to the other, and the engaging portions to be engaged with each other are provided on the facing surfaces 41 of the cores 40. According to this configuration, the primary molded bodies 20 and a device such as a mold for molding the primary molded bodies 20 can be used in common.

Further, the engaging portions to be engaged with each other are provided on the facing surfaces 41 of the cores 40 in the overlapped primary molded bodies 20. Thus, two primary molded bodies 20 can be positioned with respect to each other when molding the housing 50.

The engaging portions include the engaging projection 45 projecting from the facing surface 41 of one core 40 and the engaging recess 46 formed in the facing surface 41 of the other core 40 and to be engaged with the engaging projection 45 while accommodating the engaging projection 45. By accommodating the engaging projection 45 into the engaging recess 46 in this way, the cores 40 will not slip on each other in a surface direction of the facing surfaces 41 or rotate with respect to each other. Thus, the cores 40 can be positioned easily with respect to each other.

The core 40 has the first end surface 42 orthogonal to the facing surface 41 and the second end surface 43 orthogonal to the facing surface 41 and located opposite to the first end surface 42. Each metal terminal 30 includes the first extending portion 31 extending out from the first end surface 42 and the second extending portion 32 extending out from the second end surface 43. The first extending portions 31 and the second extending portions 32 in the primary molded body 20 are arranged side by side at intervals in the orthogonal direction Z, and the second extending portions 32 are arranged closer to the facing surface 41 than the first extending portions 31 in the facing direction X. With the respective primary molded bodies 20 overlapped with each other, the first extending portions 31 of one primary molded body 20 and the first extending portions 31 of the other primary molded body 20 are arranged in two rows. On the other hand, the second extending portions 32 of the one primary molded body 20 and the second extending portions 32 of the other primary molded body 20 are arranged in one row. According to this configuration, with the respective primary molded bodies 20 overlapped with each other, the first and second extending portions 31 and 31 are arranged in different manners. Thus, a degree of freedom in the terminal arrangement of the connector 10 can be enhanced while the primary molded bodies 20 having the same shape are used.

Each metal terminal 30 has the bent portion 34 between the first and second extending portions 31, 32 and bent to be closer to the facing surface 41 as approaching the second extending portion 32. The engaging portions include the projection 47 projecting from the facing surface 41 of one core 41 and the recess 48 in the facing surface 41 of the other core 40 and engageable with the projection 47. The bent portion 34 is embedded in the projection 47. According to this configuration, since the bent portion 34 located between the first and second extending portions 31, 32 is embedded in the projection 47, a pressure of the resin during the molding of the housing 50 is less likely to act on the bent portion 34 and the deformation of the bent portion 34 can be suppressed. Further, by engaging such a projection 47 with the recess 48 of the mating core 40, the cores 40 are positioned with respect to each other. Thus, a part of the core 40 provided to suppress the deformation of the bent portions 34 and a part thereof to be engaged with the recess 48 of the mating core 40 need not be formed separately. In this way, the shape of the cores 40 can be simplified and a material necessary to mold the cores 40 can be reduced.

This embodiment can be modified and carried out as follows. The following modifications can be carried out in combination without technically contradicting each other.

The through hole 44 of the core 40 can be omitted.

The shape of each metal terminal 30 can be changed as appropriate.

If the cores 40 are engaged with each other by the engaging portions, the facing surfaces 41 may not be in contact with each other.

The bent portion 34 may be exposed from the core 40 without being embedded in the projection 47 of the core 40.

The shapes of the projection 47 and the recess 48 can be changed as appropriate.

If the engaging projection 45 and the engaging recess 46 are provided, the projection 47 and the recess 48 can be omitted.

The primary molded body 20 may include only one metal terminal 30.

The arrangement of the metal terminals 30 can be changed as appropriate. For example, with the respective primary molded bodies 20 overlapped with each other, the respective first extending portions 31 of one primary molded body 20 and the respective first extending portions 31 of the other primary molded body 20 may be arranged in one row and the respective second extending portions 32 of the one primary molded body 20 and the respective second extending portions 32 of the other primary molded body 20 may be arranged in one row. Further, the respective first extending portions 31 of one primary molded body 20 and the respective first extending portions 31 of the other primary molded body 20 may be arranged in two rows and the respective second extending portions 32 of the one primary molded body 20 and the respective second extending portions 32 of the other primary molded body 20 may be arranged in two rows. In this case, the intermediate portions 33 and the bent portions 34 can also be omitted.

The intervals in the orthogonal direction Z between the respective first extending portions 31 and those between the respective second extending portions 32 can also be changed as appropriate.

The shapes of the engaging projection 45 and the engaging recess 46 can be changed as appropriate.

If the projection 47 and the recess 48 are provided, the engaging projection 45 and the engaging recess 46 can be omitted.

Engaging portions can also be configured by providing a protrusion projecting from the facing surface 41 and engaging the outer peripheral surface of this protrusion with the outer peripheral surface of a protrusion on the mating core 40.

LIST OF REFERENCE SIGNS

X facing direction
Y extending direction

Z orthogonal direction
10 connector
20 primary molded body
30 metal terminal
31 first extending portion
32 second extending portion
33 intermediate portion
34 bent portion
40 core
41 facing surface
42 first end surface
43 second end surface
44 through hole
45 engaging projection
46 engaging recess
47 projection
48 recess
50 housing
51 body portion
52 outer receptacle
53 inner receptacle
54 flange
55 collar
56 sealing member
100 case
101 mounting hole
102 screw hole
110 bolt

What is claimed is:

1. A connector, comprising:

metal terminals;

a first primary molded body including a first core made of resin and molded while holding at least one of the metal terminals (30), and a second primary molded body including a second core made of resin and molded while holding at least one of the metal terminals; and a housing made of resin and molded with the primary molded bodies inserted, wherein:

the first and second primary molded bodies have the same shape and size and are overlapped with one inverted with respect to the other, and engaging portions to be engaged with each other are provided on facing surfaces of the first and second cores facing each other.

2. The connector of claim 1, wherein the engaging portions include an engaging projection projecting from the facing surface of each of the first and second cores and an engaging recess formed in the facing surface of each of the first and second cores, the engaging recess on the first core being engaged with the engaging projection on the second core, and the engaging recess on the second core being engaged with the engaging projection on the first core.

3. A connector, comprising:

metal terminals;

two primary molded bodies including cores made of resin and molded while holding the metal terminals so that each of the primary molded bodies holds a plurality of the metal terminals;

a housing made of resin and molded with the primary molded bodies inserted, wherein:

the primary molded bodies have the same shape and are overlapped with one inverted with respect to the other, engaging portions to be engaged with each other are provided on facing surfaces of the cores facing each other each of the cores has a first end surface orthogonal to the facing surface and a second end surface orthogonal to the facing surface and located opposite to the first end surface, each of the metal terminals includes a first extending portion extending out from the first end surface and a second extending portion extending out from the second end surface, when a facing direction of the cores is defined as a facing direction, an extending direction of the first and second extending portions is defined as an extending direction and a direction orthogonal to both the facing direction and the extending direction is defined as an orthogonal direction, the respective first extending portions and the respective second extending portions in the primary molded body are arranged at intervals in the orthogonal direction and the respective second extending portions are arranged closer to the facing surface than the respective first extending portions in the facing direction, and with the primary molded bodies overlapped with each other, the respective first extending portions of one of the primary molded bodies and the respective first extending portions of the other of the primary molded bodies are arranged in two rows, whereas the respective second extending portions of the one primary molded body and the respective second extending portions of the other primary molded body are arranged in one row.

4. The connector of claim 3, wherein:

each of the metal terminals includes a bent portion located between the first and second extending portions and bent to be located closer to the facing surface while approaching the second extending portion, the engaging portions include a projection projecting from the facing surface of one of the cores and a recess formed in the facing surface of the other core and engageable with the projection, and the bent portion is embedded in the projection.

5. The connector of claim 1, wherein each of the primary molded bodies has opposite first and second end surfaces, the first end surfaces of the primary molded bodies being aligned with one another and facing in a first direction from the connector and the second end surfaces of the primary molded bodies being aligned with one another and facing in a second direction from the connector, each of the metal terminals has a first extending portion extending from the first end surface of a respective one of the first and second primary molded bodies and a second extending portion extending from the second end surface of a respective one of the first and second primary molded body.

6. The connector of claim 5, wherein each of the first and second primary molded bodies has opposite end edges extending between the first and second end surfaces, each of the metal terminals being disposed inward of the end edges of the of the primary molded bodies.

* * * * *